US006363993B1

(12) United States Patent
Aquilina

(10) Patent No.: US 6,363,993 B1
(45) Date of Patent: Apr. 2, 2002

(54) PIVOTING BRACKET FOR CONNECTING ARTICULATED DOOR PANELS

(76) Inventor: Anthony George Aquilina, R.R. 5, Milton, Ontario (CA), L9T 2X9

( * ) Notice: Subject to any disclaimer, the term of this patent is extended or adjusted under 35 U.S.C. 154(b) by 0 days.

(21) Appl. No.: 09/514,358

(22) Filed: Feb. 28, 2000

(51) Int. Cl.[7] ..... E06B 3/48

(52) U.S. Cl. ..... 160/229.1; 160/201; 160/232; 16/355

(58) Field of Search ..... 160/40, 199, 201, 160/206, 133, 135, 196.1, 207, 229.1, 231.1, 232; 16/355

(56) References Cited

U.S. PATENT DOCUMENTS

| | | | | | |
|---|---|---|---|---|---|
| 4,115,900 | A | | 9/1978 | Mihalcheon | 16/104 |
| 4,644,724 | A | | 2/1987 | Schijf | 52/588 |
| 4,736,785 | A | * | 4/1988 | Seuster | 160/229.1 X |
| 4,748,783 | A | * | 6/1988 | Labelle | 160/229.1 X |
| 4,823,531 | A | * | 4/1989 | Labelle | 160/232 X |
| 4,893,666 | A | | 1/1990 | Hormann | 160/229.1 |
| 4,924,932 | A | | 5/1990 | Esnault | 160/201 |
| 5,002,114 | A | | 3/1991 | Hormann | 160/229.1 |
| 5,148,850 | A | | 9/1992 | Urbanick | 160/231.1 |
| 5,363,616 | A | * | 11/1994 | Hernandez | 52/281 |
| 5,553,651 | A | | 9/1996 | Olsen | 160/235 |
| 5,564,164 | A | | 10/1996 | Jellá | 16/355 |
| 5,566,740 | A | | 10/1996 | Mullet et al. | 160/229.1 |
| 5,622,012 | A | | 4/1997 | Schijf | 52/71 |
| 5,669,431 | A | | 9/1997 | Druzynski et al. | 160/229.1 |
| 5,742,980 | A | * | 4/1998 | Nitta | 16/355 |
| 5,782,283 | A | | 7/1998 | Kendall | 160/229.1 |
| 5,884,363 | A | * | 3/1999 | Tofts | 16/223 |
| 5,913,352 | A | * | 6/1999 | Scates et al. | 160/229.1 |
| 5,921,307 | A | | 7/1999 | Ford et al. | 160/229.1 |
| 5,927,369 | A | * | 7/1999 | Pedersen | 160/229.1 X |
| 5,934,352 | A | * | 8/1999 | Morgan | 160/201 |
| 6,076,590 | A | * | 6/2000 | Ford et al. | 160/229.1 |

FOREIGN PATENT DOCUMENTS

| | | | |
|---|---|---|---|
| DE | 91 01 597.9 | 6/1992 | E06B/9/08 |
| EP | 159058 | 10/1985 | 160/232 |
| EP | 0 623 714 A1 | 5/1994 | E05D/1/04 |
| FR | 1368026 | 9/1964 | 52/592.3 |
| GB | 1571853 | 7/1980 | 16/355 |
| GB | 2072248 | 9/1981 | 160/235 |
| GB | 2157752 | 10/1985 | 160/232 |
| GB | 2208303 | 3/1989 | 16/355 |
| WO | WO 98/41723 | 9/1998 | E06B/3/48 |

OTHER PUBLICATIONS

Amarr Garage Doors (Weatherguard Featuring our DuraSafe System).

* cited by examiner

*Primary Examiner*—Bruce A. Lev
(74) *Attorney, Agent, or Firm*—Gowling Lafleur Henderson LLP

(57) ABSTRACT

A pivoting bracket for connecting adjacent panels of an articulated door. The pivoting bracket has a generally cylindrical base and an arm rigidly connected to and extending from the base. The arm has a mounting face on a base side which is generally parallel to a tangent to the base. A recess extends into at least one end of the base, generally co-axially therewith, for receiving a guidewheel shaft. The pivoting bracket interacts with adjacent articulated door panels to mount the panels to a guide track and allow articulated movement without requiring or modifying a conventional hinge. The arm has a first part proximal the base and a second part distal the base. The second part is securable to an upper articulated door panel. The base extends into a channel provided on a rearward face of a lower articulated panel. The base of the arm pivots and interlocks itself relative to the channel while the door articulates.

28 Claims, 11 Drawing Sheets

PIVOTING BRACKET FOR CONNECTING ARTICULATED DOOR PANELS

FIELD OF THE INVENTION

This invention relates to garage type doors and more particularly to sectional or "articulated" doors. Even more particularly this invention relates to privoting brackets for linking adjacent door panels to allow articulation.

IN THE BACKGROUND OF THE INVENTION

Articulated doors consist of a number of interconnected panels, usually arranged one above another and guided for movement by guidewheels or rollers along a curved track to either side of the panels. In a closed configuration the panels are arranged generally vertically. In an open configuration at least the uppermost panels lie substantially horizontally.

The individual panels have traditionally been connected by hinges having a first part attached to one panel, a second part connected to the adjacent panel and a pivot, generally in the form of a hinge pin pivotally connecting the two parts for rotation about the pin axis. The guidewheels are usually carried by separate brackets respective shafts which double as hinge pins for the hinges. Traditional "hardware" in the form of hinges and guidewheel brackets is relatively expensive and heavy.

More recently articulated doors have been developed which overcome a hazard associated with the way earlier designs articulate. In earlier designs the panels had substantially planar adjacent edges and the articulation associated with the panels following the curved section of the track would cause the adjoining edges to open and close in a clamshell fashion which could cause grievous injury if one's fingers were to get captured therebetween.

More recent designs provide matched arcuate surfaces which ride one over the other in closely spaced juxtaposition as the panels articulate. Accordingly, the articulation action becomes more of a "wiping" action tending to push fingers out of the space than an opening/closing action tending to pinch. Such is referred to herein as a "pinch resistant" design.

It is an object of the present invention to provide a pivoting bracket for connecting adjacent panels of an articulated door which allows for articulated movement yet is simple, easy to manufacture and install, cost effective and devoid of a hinge pin.

It is a further object of the present invention to provide such a pivoting bracket which may be used in conventional and in pinch resistant articulated door designs.

It is also an object of the present invention to provide an articulated door having panels adapted for and connected by a novel pivoting bracket arrangement.

SUMMARY OF THE INVENTION

A pivoting bracket for connecting adjacent panels of an articulated door. The pivoting bracket has a generally cylindrical base with an arm rigidly connected to and extending from the base. The arm has a mounting face on a base side thereof, the mounting face being generally parallel to a tangent to the base. The pivoting bracket further may have a recess extending into at least one end of the base, generally co-axially therewith for receiving a guidewheel shaft.

The base may have a relieved portion generally perpendicular to the mounting face to permit insertion of the base into an open face of a generally C-shaped channel. The arm may have a first part proximal the base and a second part distal the base. The arm may also have a rib extending along the base side of the arm generally parallel to the axis of the generally cylindrical base located between the first and second parts.

The mounting face may be on the second part of the arm and at least one ridge may extend along the first part of the arm on the base side thereof.

The base may be generally tubular and the pivoting bracket may have a profile which allows for manufacture by extrusion or injection molding.

The pivoting bracket may be manufactured from a plastics material.

An articulated door is provided which has a plurality of adjacent panels, including a first, a last and at least one intermediate panel. Each of the last and intermediate panels has a leading edge. Each of the first and intermediate panels has a trailing edge. Each leading edge registers with a trailing edge of the adjacent panel. Each of the last and intermediate panels has a channel extending into and running along a rearward face thereof. A plurality of pivoting brackets are provided for linking adjacent of the panels. Each of the pivoting brackets has a generally cylindrical base received in the channel and generally co-axial with a respective axis thereof. Each pivoting bracket has an arm rigidly connected to and extending from the base, the arm having a mounting face on the base side thereof which registers with and is secured to a rearward face of one of the intermediate or first panels adjacent its trailing edge. The mounting face is generally tangential to the base. Each pivoting bracket may further have a recess extending into at least one end of the base. A retainer acts between the channel and the base for retaining the base in the channel at least during relative pivoting of the adjacent panels away from a closed configuration.

Each leading edge may have an outwardly facing convex surface which registers with an inwardly facing concave surface of an adjacent trailing edge. In such an embodiment the channel may have an axis generally co-axial with a focal axis of the convex surface.

The arm of the pivoting bracket may further comprise a first part proximal the base and adjacent the rearward face of respective of the last and intermediate panels, and a second part distal the base. The mounting face may be on the second part and a rib may extend along the base side of the arm generally parallel to the axis of the generally cylindrical base between the first and second parts. The rib acts as an alignment indicator in mounting the pivoting bracket to respective of the first and intermediate panels to assist in positioning the convex and concave surfaces in a spaced apart relationship.

At least one ridge may extend along the first part of the pivoting bracket on the base side thereof to abut against the rearward face of respective of the last and intermediate panels when the articulated door is an enclosed arrangement to maintain a portion of the base side of the first part and a rearward face in a spaced apart relationship.

The base of the pivoting bracket may be tubular and the pivoting bracket may be manufactured from a plastics material.

The base may have a relieved portion generally perpendicular to the mounting face to allow insertion of the base into the channel.

In one embodiment, the channel has a generally C-shaped cross-section and the base has a relieved portion generally perpendicular to the mounting faced permit insertion of the base into an open face of the channel. Inwardly extending opposite edges of the channel act as the retainer by engaging an outer face of the base as the pivoting bracket is rotated to move the relieved portion away from one of the opposite edges.

In another embodiment, the channel has a generally rectangular cross-section and the retainer includes a pair of end members disposed entirely within and generally perpendicular to a bottom of the channel for receiving one of the pivoting brackets therebetween. A pin is insertable through the end members into the recess to support the pivoting bracket for rotation about the axis of the channel.

In yet another embodiment, the channel has a rectangular cross-section and houses an insert with a circular groove of generally C-shaped cross-section for receiving the base of the pivoting bracket. Inwardly extending opposite edges of the channel act as the retainer by engaging an outer face of the base as the pivoting bracket is rotated to move the relieved portion away from one of the opposite edges.

DESCRIPTION OF DRAWINGS

Preferred embodiments of the present invention are described below with reference to the accompanying drawings which illustrate aspects of the invention and in which.

DETAILED DESCRIPTION OF THE INVENTION

Figure 1:
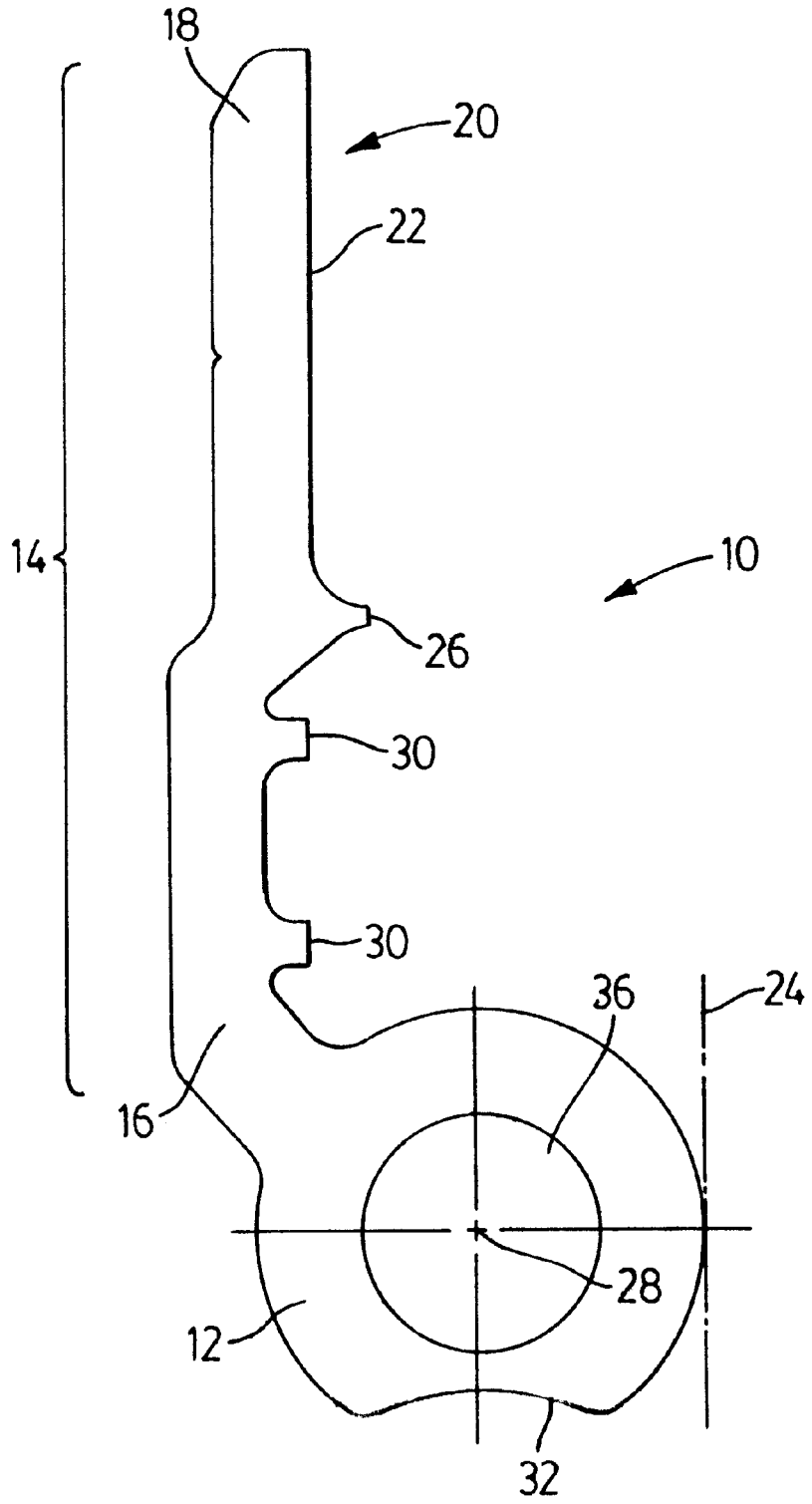
FIG. 1 is an end view through a pivoting bracket according to the present invention.
Figure 2:
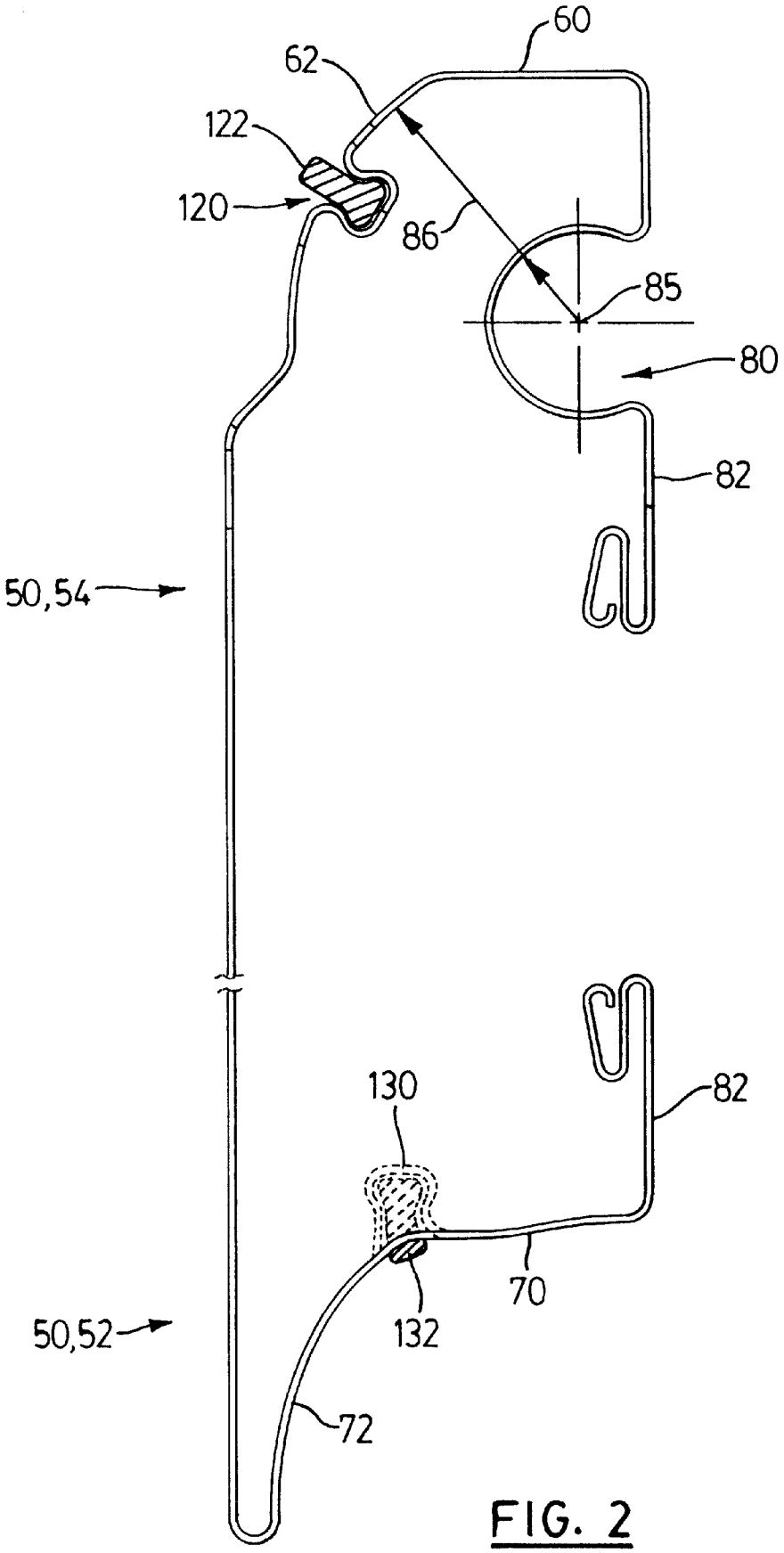
FIG. 2 is a sectional view through a door panel of an articulated door according to one aspect of the present invention.

A pivoting bracket according to the present invention is generally indicated by reference 10 in FIGS. 1, 3, 4 and 5. The pivoting bracket 10 has a generally cylindrical base 12 from which extends an arm 14 which is rigidly connected to the base 12 and may be integral therewith.

The arm 14 has a first part 16 proximal the base 12 and a second part 18 distal the base 12. The arm 14 has a base side 20 facing generally toward the direction of the base, although not directly at the base.

At least the second part 18 of the arm 14 has a mounting face 22 which is generally parallel to a tangent 24 to the base 12. The mounting face abuts against and registers with a door panel as described in more detail below.

A rib 26 extends along the base side 20 of the arm 14 between the first part 16 and second part 18. The rib 26 is generally parallel to the axis 28 of the generally cylindrical base 12.

A pair of ridges 30 are shown to extend along the first part 16 of the arm 14. The ridges 30, as described in more detail below, maintain the base side of the first part 16 of the arm 14 in a spaced apart relationship with an adjacent door panel. Two ridges 30 are illustrated. One would probably suffice. More may be used but may be superfluous. Other forms of spacer may be used, such as bumps, and the ridges 30 need not be continuous. An advantage to continuous ridges 30 is that they lend themselves to manufacture by extrusion.

The base 12 may include a "relieved" portion 32 to assist in installation of the pivoting bracket 10. This is discussed in more detail below. The relieved portion is generally perpendicular to the mounting face 22. As best illustrated in FIG. 3A, the base 12 also includes a recess 36 extending into at least one end thereof for receiving a shaft 38 extending from a guidewheel 40.

A panel for an articulated door according to the present invention is generally indicated by reference 50 in the Figures. The door would typically consist of a number of panels such as panel 50 arranged one above another. Although the panels may all be identical the uppermost or "first" panel wouldn't require provision to connect to a panel above it. Similarly, the bottom or "last" panel wouldn't require provision to attach to a panel below it and in fact it may be desirable to have provision for the securement of weatherstripping thereto. Accordingly, the description refers to first, intermediate and last panels with reference 50 identifying intermediate panels, reference 52 indicating features of a first panel and reference 54 indicating features of a last panel.

Figure 3:
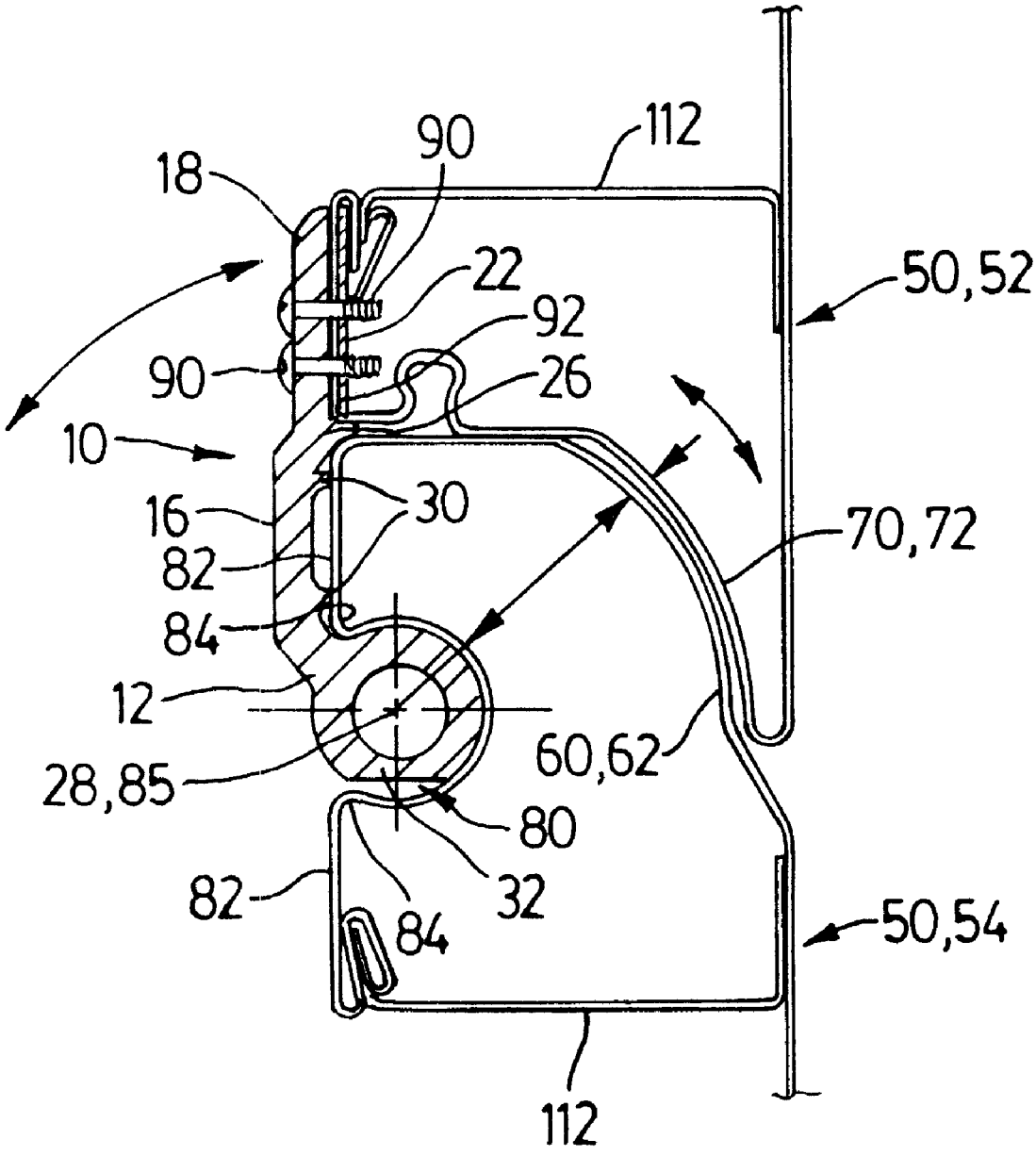
FIG. 3 is a sectional view illustrating a privoting bracket according to the present invention connecting adjacent door panels.
Figure 3A:
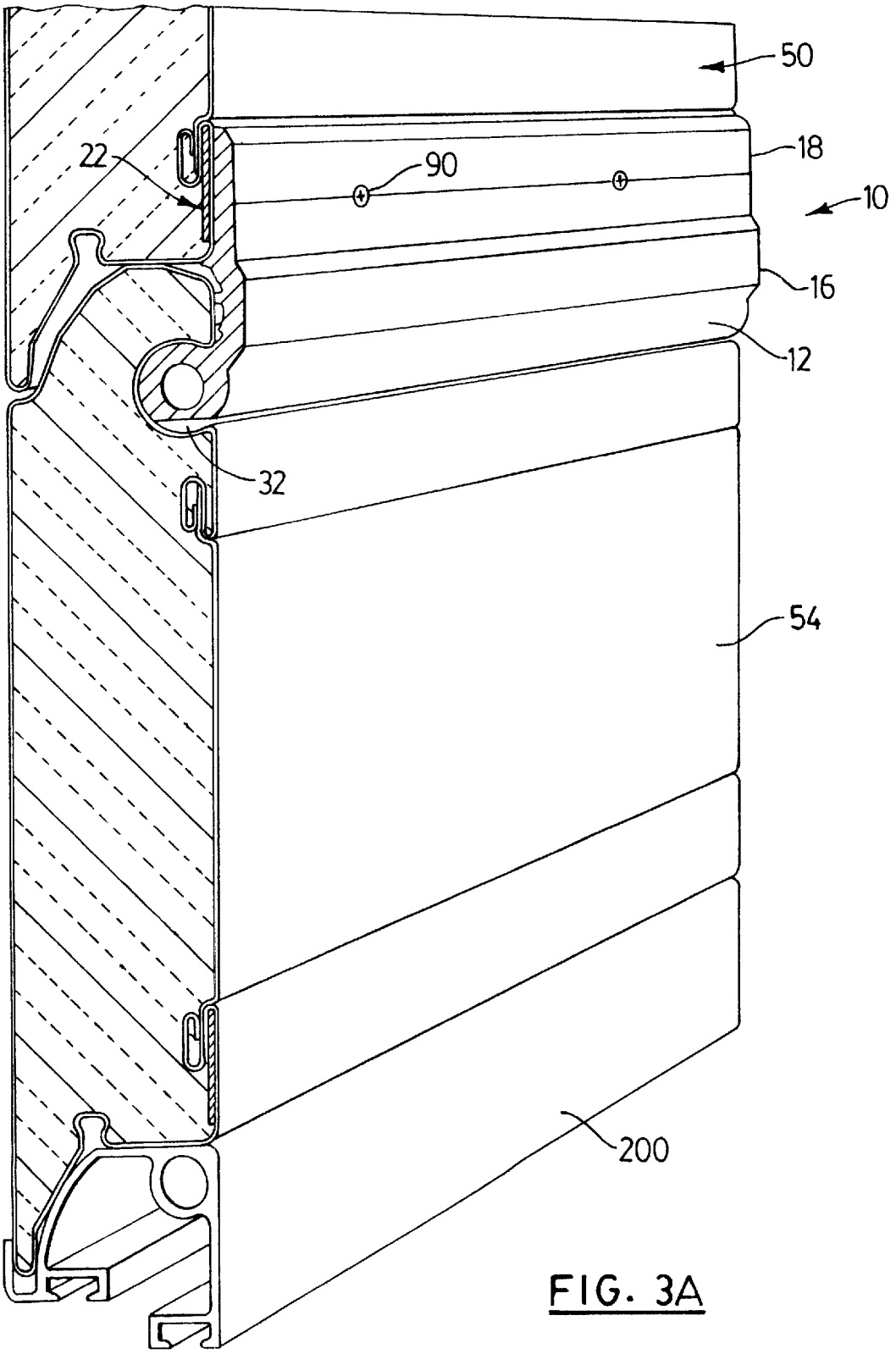
FIG. 3A is a perspective view illustrating the lower portion of an articulated door according to one embodiment of the present invention in which the privoting bracket extends the full width of the door.

FIG. 3A illustrates an arrangement wherein an intermediate panel 52 is adapted as a last panel 54 by an extruded molding 200 secured to the trailing edge 70 for attachment of weatherstripping (not shown) to the trailing edge 70.

Each last panel 54 and intermediate panel 50 has a leading edge 60. Each first panel 52 and intermediate panel 50 has a trailing edge 70. The trailing edge 70 is opposite the leading edge 60 in the case of the intermediate panels 50.

In a preferred embodiment, each leading edge 60 has a forwardly facing convex surface 62. Each trailing edge 70 has a downwardly facing concave surface 72. Each convex surface 62 registers with an adjacent concave surface 72 in the preferred embodiment of the invention, which in conjunction with the pivoting bracket 10 provides for pinch resistant panel joint operation.

Each last panel 54 and intermediate panel 50 has a channel 80 extending into and running along a rearward face 82 thereof. The channel 80 has an axis 84 which is generally coaxial with a focal axis of the convex surface 62 as indicated by arrow 86. This geometry, as will become more apparent, allows for the proper alignment of the convex surface 62 and concave surface 72 during articulation.

Reference is now made to FIGS. 3, 3A, 4 and 4A which illustrate the relative juxtaposition of the pivoting bracket 10, the trailing edge 70 of an intermediate panel 50 or first panel 52 and the leading edge 60 of an intermediate panel 50 or last panel 54. The base 12 of the pivoting bracket is received in the channel 80 and is generally coaxial with the axis 84 of the channel 80.

The mounting face 22 on the second part 18 of the arm registers with and is secured by fasteners 90 to the rearward face 82 of the intermediate panel 50 or first panel 52. A reinforcing strip 92 may be provided adjacent the rearward face 82 in the case of sheet metal doors to provide more secure anchoring for the fasteners 90. The relieved portion 32 of the base 12 in the FIG. 3 embodiment enables the base 12 to be inserted into the face of the channel 80, rather than slid along its length.

The rib 26 acts as an alignment indicator when the pivoting bracket is mounted to the intermediate panel 50 and the adjacent first, last or intermediate panel 52, 54 or 50 respectively. In order to attach the second part of the arm to the rearward face 82 adjacent the trailing edge 70 and have the mounting face 22 flush against the rearward face 82, the rib 26 must project into a space between the trailing edge 70 and the adjacent leading edge 60. This requires at least the concave surface 72 and convex surface 62 to be in spaced apart relationship so as not to rub against each other during articulation.

The convex surface 62 and concave surface 72 need not be perfectly formed curves as some gap (less than a finger's thickness) is tolerable. Accordingly, the convex surface 62 and concave surface 72 may actually be a series of bends approximating a curve as illustrated in some of the Figures such as FIGS. 3, 3A, 4, 4A and 14.

Figure 4:
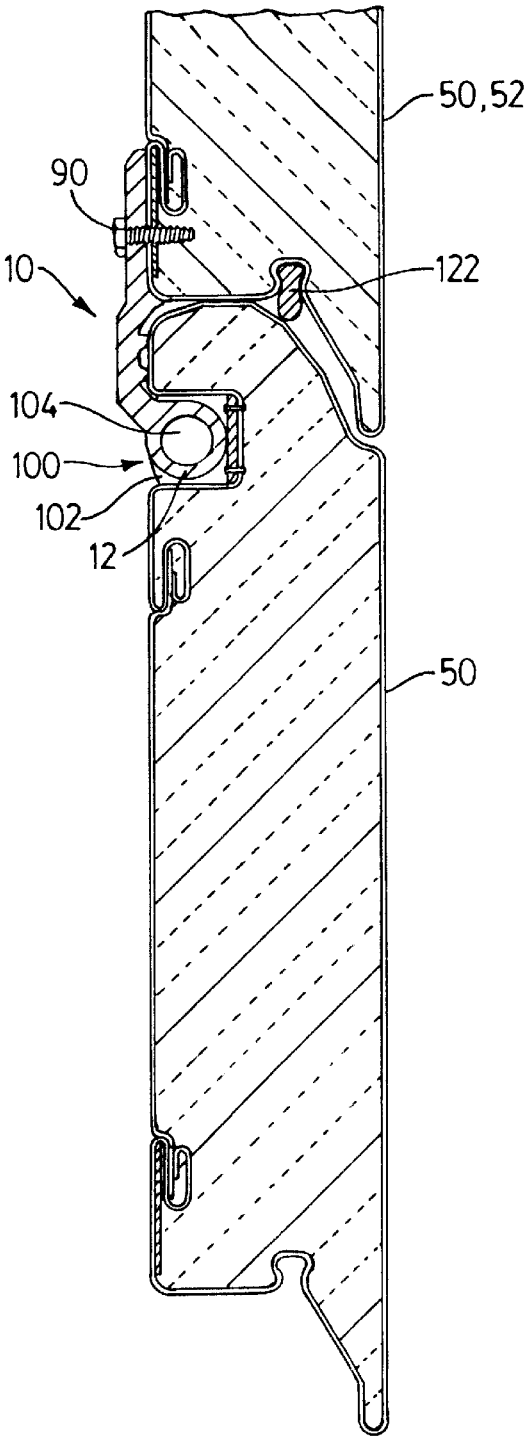
FIG. 4 is a sectional view illustrating a privoting bracket according to the present invention in association with an alternate door panel configuration having a rectangular channel.
Figure 4A:
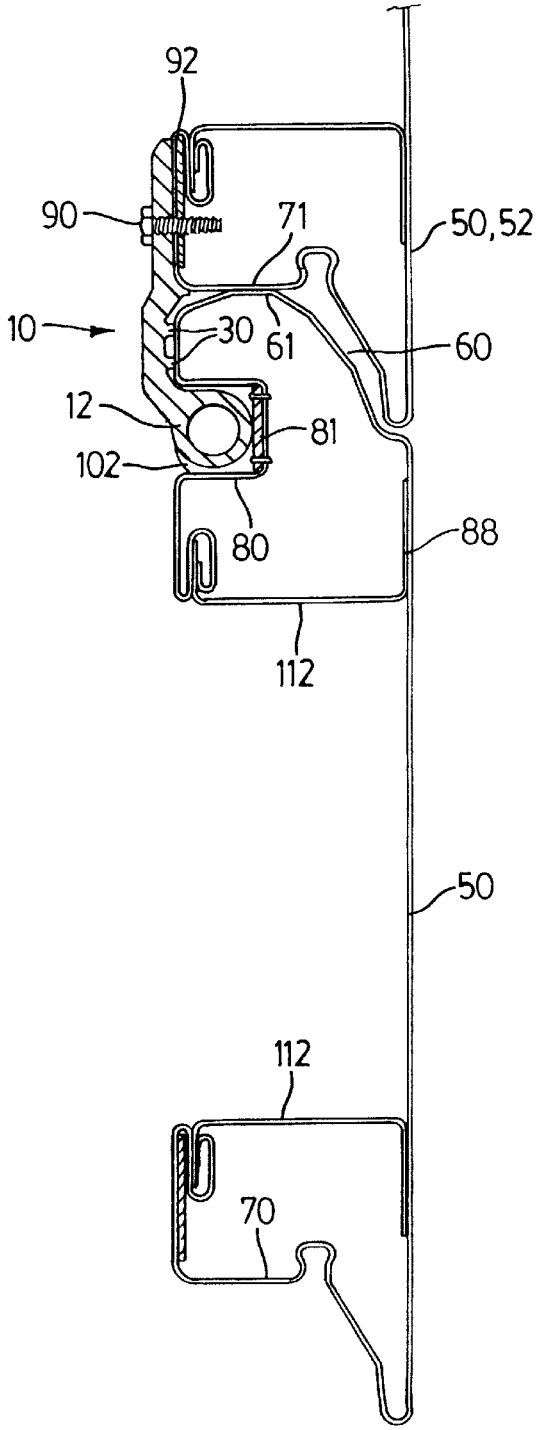
FIG. 4A is a view similar to FIG. 4 but illustrating an uninsulated door.

Although the convex surface 62 and concave surface 72 should not rub against each other, a part of the leading edge 60, illustrated by reference 61 in FIG. 4A may rest against a corresponding part 71 of the trailing edge 70 in a closed configuration so that underlying panels 50 carry at least some of the weight of overlying panels 50 rather than having the pivoting brackets 10 carry all of the weight.

The ridges 30 extending from the first part 16 of the arm 14 abut against the rearward face 82 of the intermediate panel 50 or last panel 54 which houses the base 12 when the door is in a closed configuration. This maintains that portion of the base side of the first part 16 on either side of the ridges 32 in a spaced apart relationship relative to the rearward face 82. The resultant space accommodates dirt which might otherwise interfere with proper closing of the door.

The guidewheel shaft 38 of the guidewheel 40 is insertable into the recess 36 of the pivoting bracket 10 thereby obviating the requirement for separate hardware to mount the guidewheels 40.

FIGS. 4, 4A, 5 and 7 illustrate a generally rectangular continuous channel 80. In the FIG. 5 embodiment, an insert block 110 is provided to register with the channel 80 and an inner face 114 with a generally C-shaped cross-section to register with the base 12 of the pivoting bracket 10.

Figure 5:
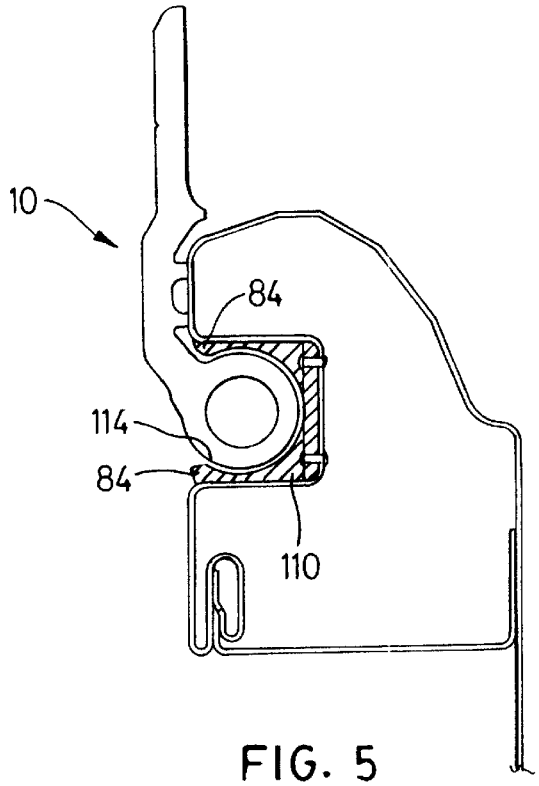
FIG. 5 is a view similar to FIG. 4 but illustrating another arrangement according to the present invention for mounting the privoting bracket.
Figure 12:
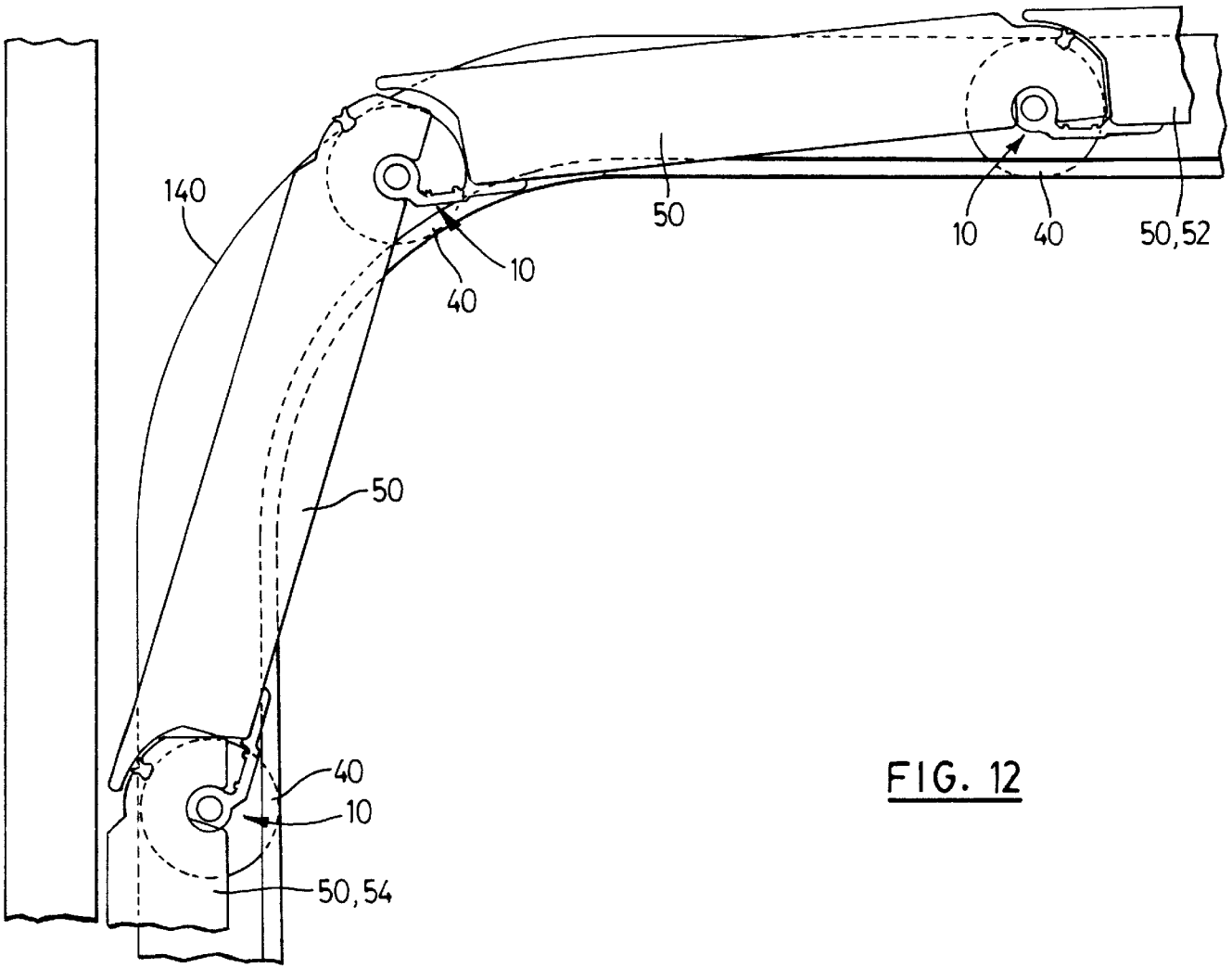
FIG. 12 is an end elevation illustrating the relative positions of adjacent door panels and respective privoting brackets disposed about a curved section of track.
Figure 13:
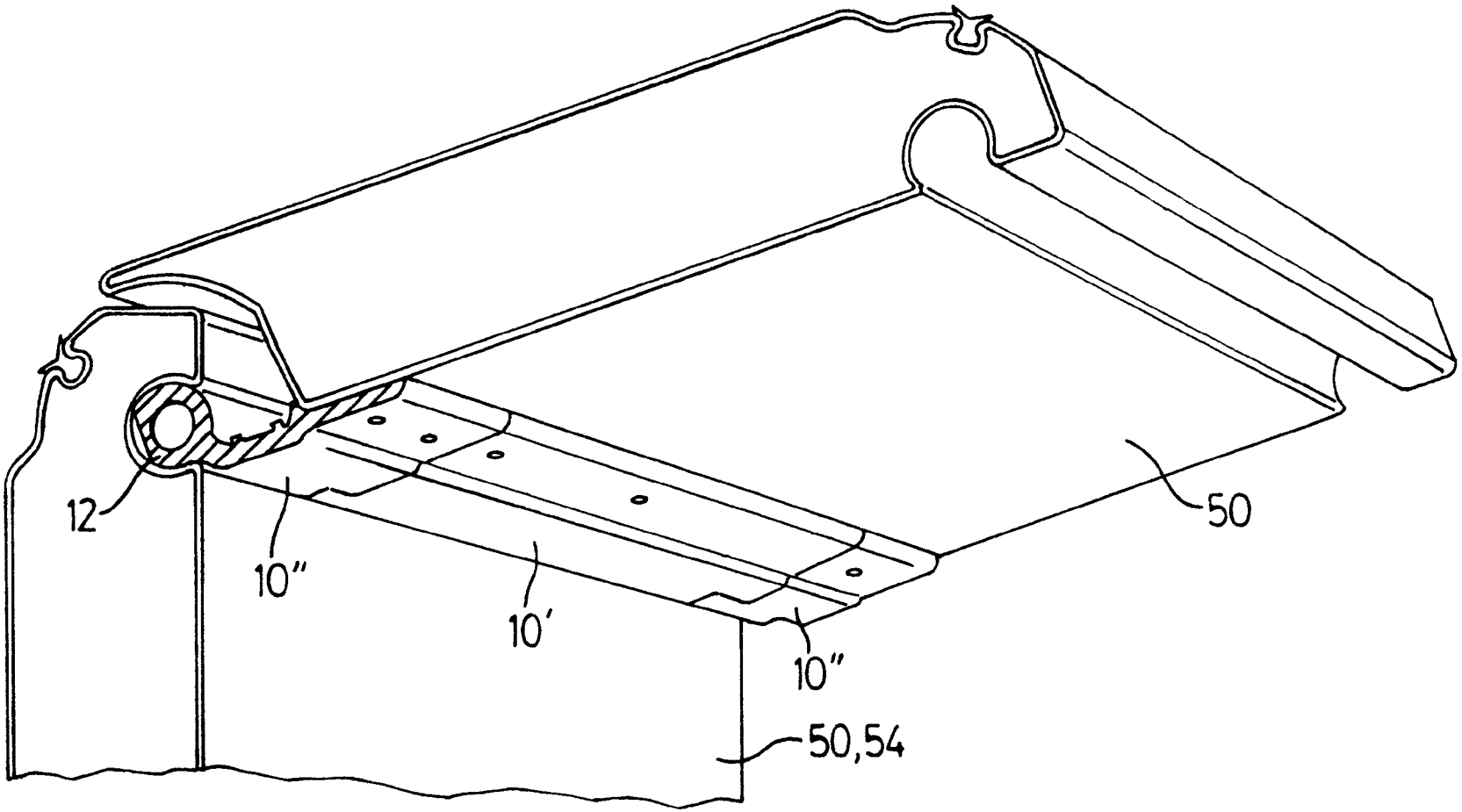
FIG. 13 is a perspective view corresponding to FIG. 12 but with the track deleted and showing parts of only two panels.

In the FIG. 5 embodiment, as in the FIGS. 3 and 3A embodiment, the base 12 is received in an opening having a generally C-shaped profile. Inwardly extending edges 84 of the channel 80 or insert 110 act as a retainer, once the panels begin to articulate, to hold the base 12 in the channel 80. FIGS. 12 and 13 illustrate how the base 12 is retained and interlocks once the relieved portion 32 rotates into the C-shaped channel 80 as the panels move from a closed configuration and articulate around a curved section of a guide track 140.

Figure 6:
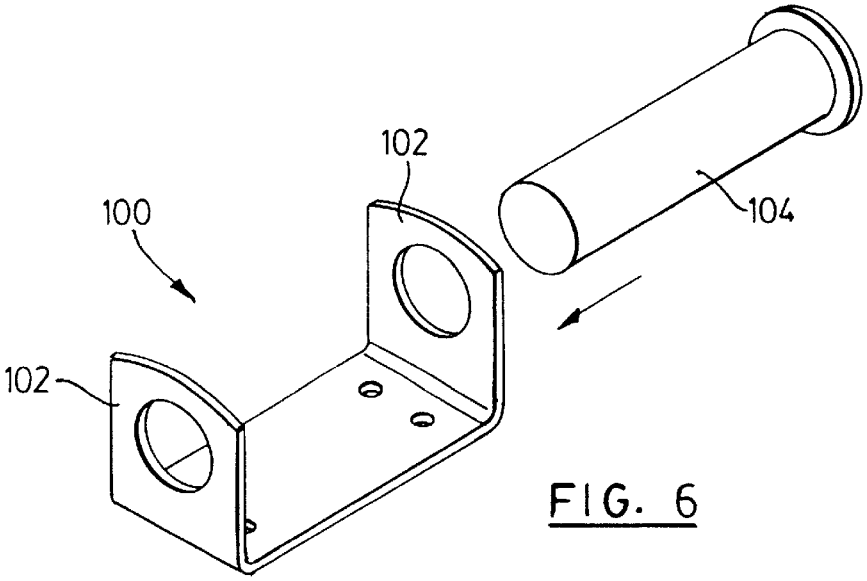
FIG. 6 is a perspective view illustrating a bracket for retaining a privoting bracket according to one aspect of the present invention.

FIGS. 4, 4A, 6 and 11 illustrate the use of a retainer in the form of a retainer bracket 100 to retain the base 12 in a rectangular channel 80. The retainer bracket 100 may be U shaped as illustrated in FIG. 6 in which case only one would be required for each pivoting bracket 10 or L shaped in which case two would be required. Other arrangements may also work such as providing a block on either side of the pivoting bracket 10 with a hole extending therethrough which registers with the sleeve 36. The retainer, such as bracket(s) 100 includes a pair of end members 102 secured to the channel 80 and generally perpendicular to a bottom 81 of the channel 80 between which is disposed a pivoting bracket 10. A pin 104 is insertable through the end members 102 and the sleeve 36 in the base 12 of the pivoting bracket 10 to retain the pivoting bracket 10 in the channel 80 yet permit it to rotate about the axis 84 of the channel 80.

Preferably, the bracket(s) 100 should be disposed in the channel 80, which is to say that the bracket(s) 100 should not project out of the channel 80 so as to allow the bracket(s) 100 to be installed when the panels are manufactured and the panels stacked without risk of scratching by the bracket(s) 100 of adjacent panels in the stack.

The door panels 50, 52 and 54 may be constructed from a variety of materials. For example, as illustrated, sheet metal may be used. The panels 50, 52 and 54 may be filled with an insulating material such as a urethane foam. When uninsulated sheet metal panels are used, it is preferable to include a reinforcing brace such as illustrated at reference 112 extending between the rear face 82 and a front face 88 of the panels 50, 52 or 54 to strengthen the panels. Alternatively, other materials such as wood and extruded plastic may be used for the door panels 50, 52 and 54.

In order to provide an enhanced seal, the convex surface 62 may include a groove 120 extending into it for receiving a sealing strip 122 of suitable material such as felt or rubber for abutting against an adjacent concave surface 72. Similarly, either in conjunction with or as an alternative, a groove 130 may be provided in or adjacent the concave surface 70 for receiving a sealing strip 132.

Figure 7:
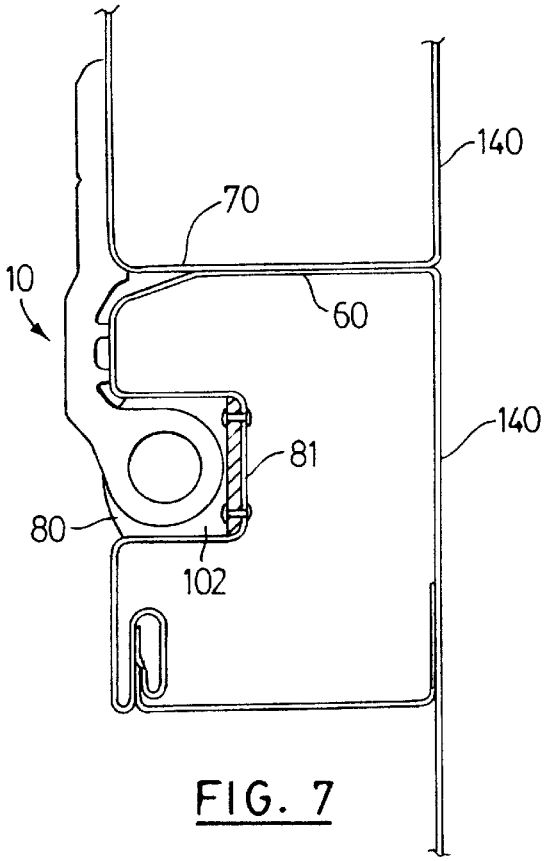
FIG. 7 is a sectional view illustrating a non pinch proof articulated door according to the present invention.

Although the invention has been illustrated with respect to a pinch resistant door, it will be appreciated that the pivoting bracket 10 could be used with planar edged panels such as the square edged panels illustrated in FIG. 7.

Figure 8:
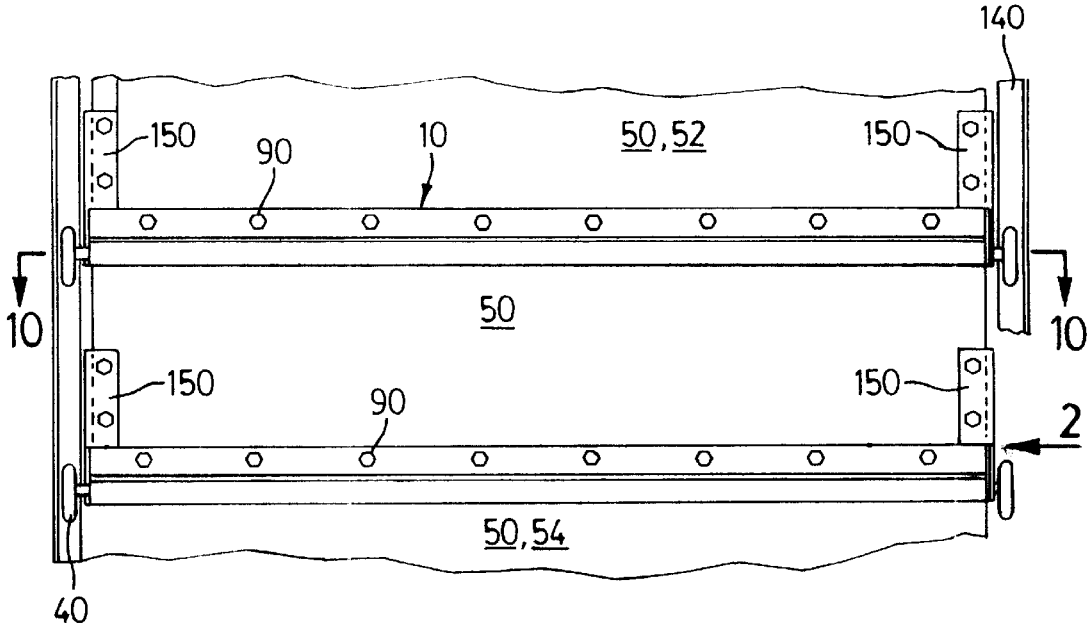
FIG. 8 is a rear elevation illustrating part of an articulated door according to the present invention with a full width privoting bracket.
Figure 9:
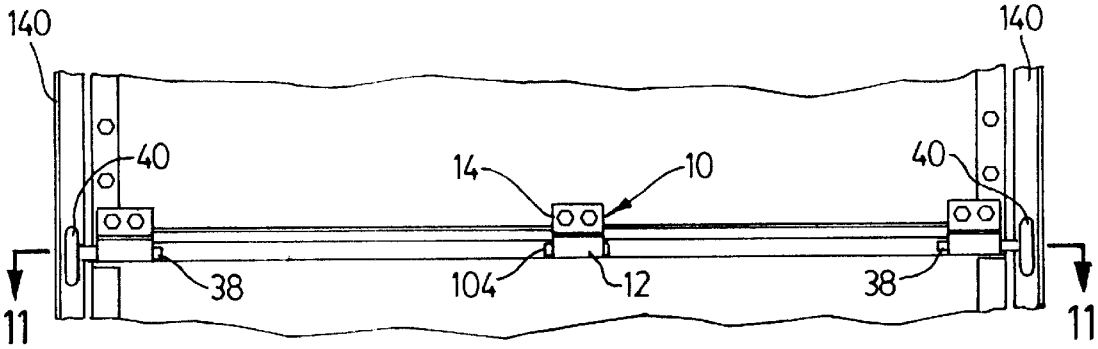
FIG. 9 is a rear elevation illustrating part of an articulated door according to the present invention with a segmented privoting bracket.
Figure 10:
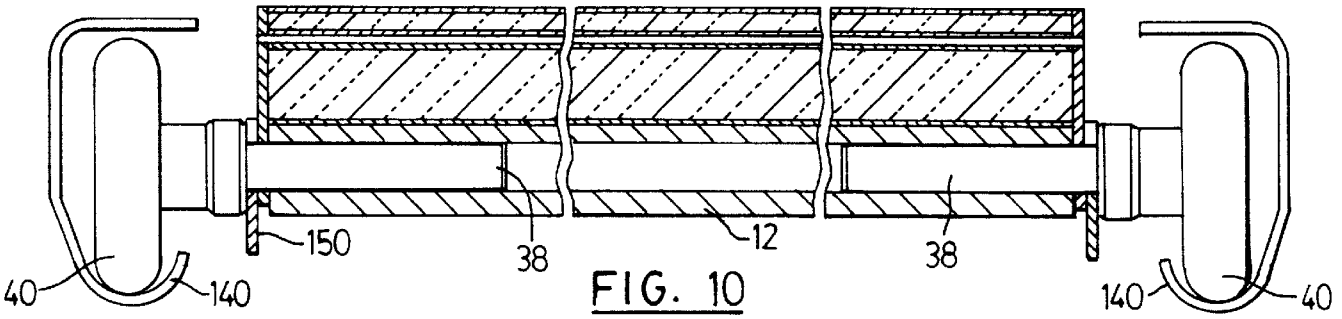
FIG. 10 is a section on line 10—10 of FIG. 8.
Figure 10A:
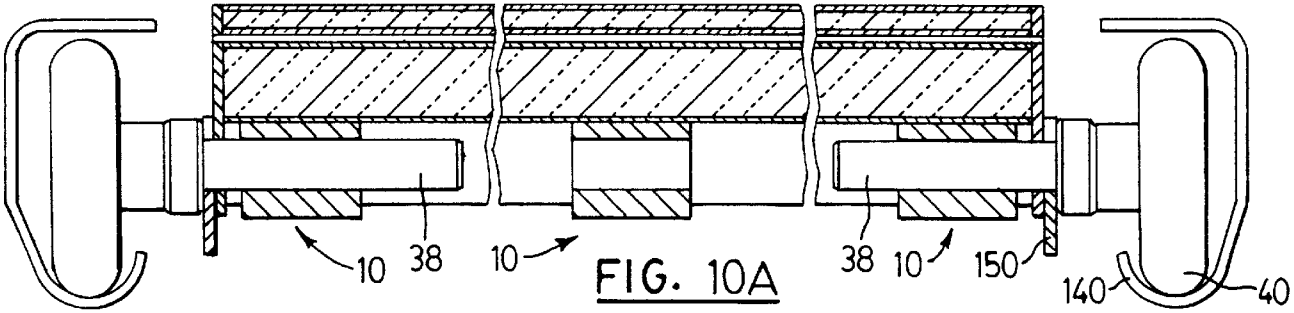
FIG. 10A is a section corresponding to FIG. 10, but illustrating a segmented privoting bracket.
Figure 11:
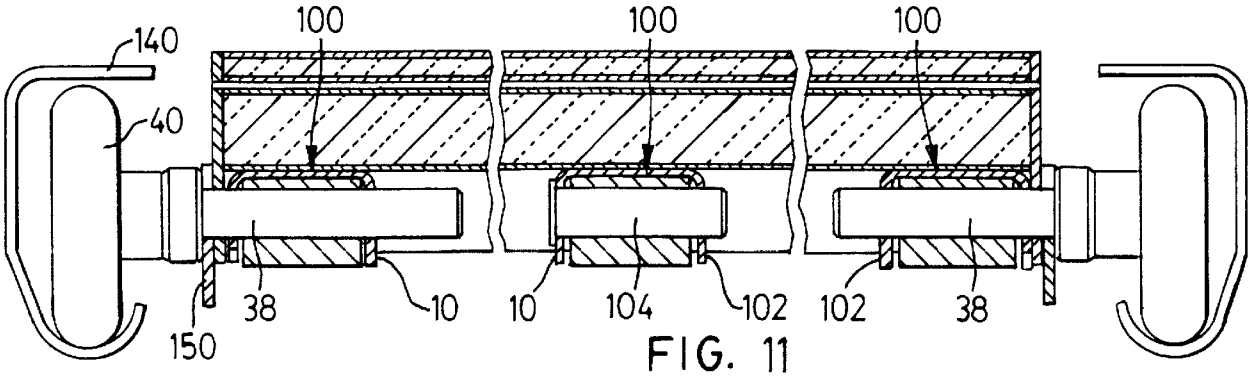
FIG. 11 is a section on line 11—11 of FIG. 9.

It should be appreciated that the pivoting bracket does not have to be one continuous strip but may instead be segmented. A segmented strip, which is illustrated in FIG. 10A, would not require cutting to fit the door width and may be less cumbersome to handle but may not be as strong or offer as good a weather seal. From an aesthetic standpoint, a full length continuous pivoting bracket 10 is preferred as it presents a very neat appearance as shown in FIGS. 3A, 8 and 13.

Figure 14:
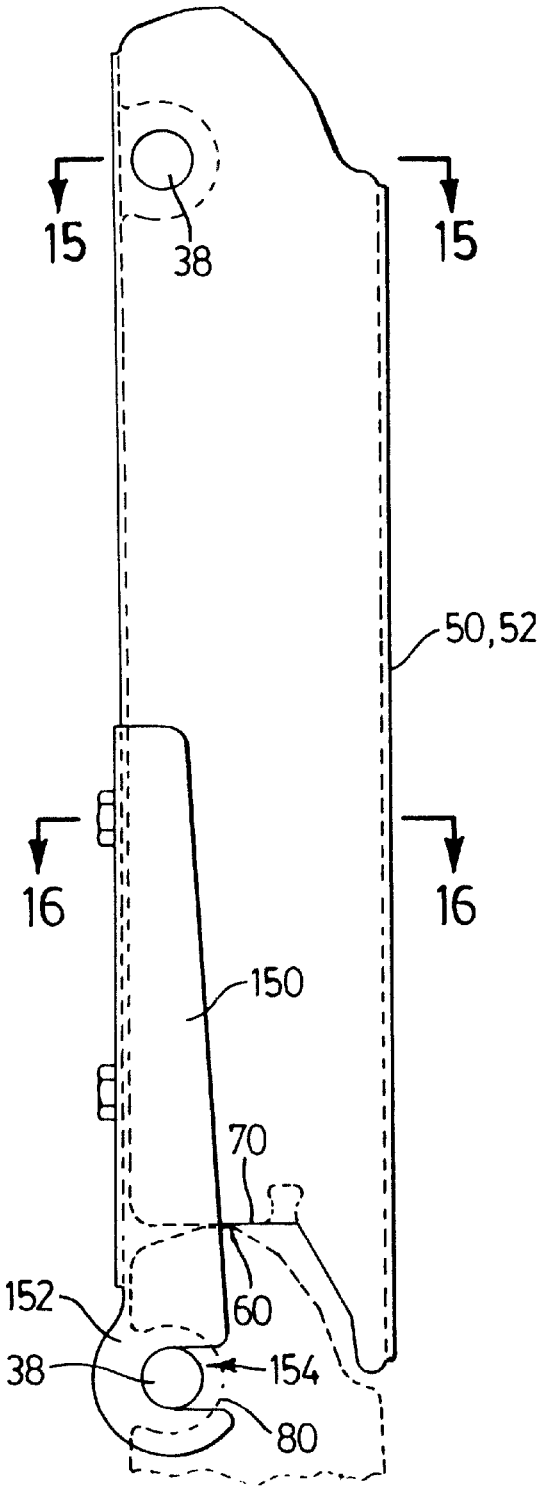
FIG. 14 is an end elevation of a door panel according to the present invention illustration an end bracket according to one aspect of the present invention.
Figure 15:
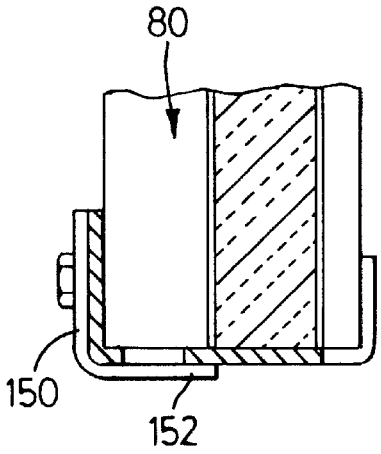
FIG. 15 is a section of line 15—15 of FIG. 14.
Figure 16:
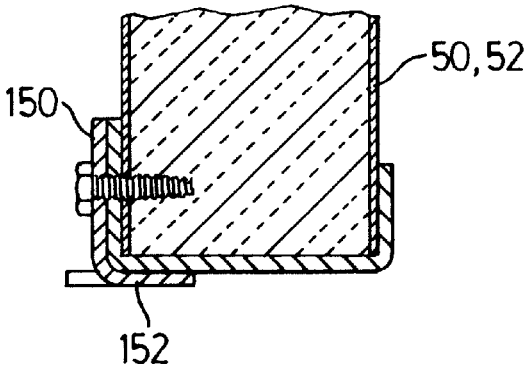
FIG. 16 is a section of line 16—16 of FIG. 14.

To provide additional support and reduce some of the load carried by the pivoting brackets, particularly in applications involving automatic door openers, and even more so with uninsulated doors which tend to be less robust, end brackets such as indicated by reference 150 in FIGS. 14 through 16 may be used. A respective bracket 150 is secured adjacent each end of the first and intermediate panels 50, 52 adjacent the trailing edge 70.

Each bracket 150 has a hook 152 which extends across the open face of the adjacent channel 80 with a slot 154 opening toward the channel 80. The slot registers with the shaft 38 of a guidewheel 40 (not shown) to provide a further link between a corresponding leading edge 60 and trailing edge 70. The use of a slot 154 (rather than a hole) enables easy replacement of the end bracket 150 after placement of the panels are between the tracks should this be required.

The above description is intended in an illustrative rather than a restrictive sense. Variants to the exact embodiments described may be apparent to persons skilled in such structures without departing from the spirit and scope of the invention as defined in the claims set out below.

I claim:

1. An articulated door comprising:

a plurality of adjacent panels including a first, a last and at least one intermediate panel;

each said last and intermediate panel having a leading edge;

each said first and intermediate panel having a trailing edge;

each said leading edge having an outwardly facing convex surface;

each said trailing edge having an inwardly facing concave surface which registers with said convex surface of an adjacent of said panels for pinch resistant articulation;

each said last and intermediate panel having a channel extending into and running along the entire breadth of a rearward face thereof adjacent said leading edge, said channel having an axis generally coaxial with a focal axis of said convex surface;

at least one pivoting bracket, for linking each adjacent pair of said panels, each of said pivoting brackets consisting of, a generally cylindrical base received in said channel and generally coaxial with said axis of said channel and an arm rigidly connected to and extending from said base, said arm having a mounting face on a base side thereof registering with a rearward face of one of said intermediate or first panels adjacent said trailing edge, said mounting face being generally tangential to said base;

a retainer acting between said channel and said base for retaining said base in said channel at least during relative pivoting of said adjacent of said panels away from a closed configuration, said retainer being entirely disposed within said channel and, connecting means for releasably connecting each said pivoting bracket to said adjacent panels when said adjacent panels are positioned with said rearward faces generally coplanar, said connecting means including at least one fastener for securing said arm to said rearward face of said intermediate or first panel;

said connecting means further includes a relieved portion on said base generally perpendicular to said mounting face for facilitating passage of said base into and out of said channel.

2. An articulated door as claimed in claim 1 wherein said arm of said connector further comprises:

a first part proximal said base and adjacent said rearward face of respective of said bottom and intermediate panels;

a second part distal said base, said mounting face being on said second part; and, a rib extending along said base side of said arm generally parallel to the axis of said generally cylindrical base, between said first and second parts, said rib acting as an alignment indicator in mounting said connector to said panels to assist in positioning said convex and concave surfaces in a spaced apart relationship.

3. An articulated door as claimed in claim 2 wherein:

at least one ridge extends along said first part of said connector on said base side thereof and abuts against said rearward face of respective of said last and intermediate panels when said articulated door is in a closed arrangement to maintain a portion of said base side of said first part and said rearward face in a spaced apart relationship.

4. An articulated door as claimed in claim 3 wherein:

said base of said connector is tubular; and, said connector is of extruded construction.

5. An articulated door as claimed in claim 4 wherein:

said connector is of plastics material.

6. An articulated door as claimed in claim 1 wherein:

said channel has a generally C shaped cross-section;

an outer face of said base engages an inner face of said C shaped channel for relative pivotal movement therebetween; and, inwardly extending opposite edges of said channel act as said retainer by engaging said outer face of said base as said pivoting bracket is pivoted to move said relieved portion away from one of said opposite edges.

7. An articulated door as claimed in claim 6 wherein:

at least one of said convex and concave surfaces includes a groove for receiving a sealing strip for abutting against the other of said convex and concave surfaces in said closed position.

8. An articulated door as claimed in claim 6 wherein:

at least one ridge extends along said first part of said pivoting bracket on said base side thereof and abuts against said rearward face of respective of said last and intermediate panels when said articulated door is in a closed arrangement to maintain a portion of said base side of said first part and said rearward face in a spaced apart relationship.

9. An articulated door as claimed in claim 6 further having:

a respective end bracket secured adjacent each end of said first and intermediate panels adjacent said trailing edge;

said bracket having a hook extending across a respective end of said channel of an adjacent leading edge of an adjacent panel with a slot opening toward said channel; and, said slot registering with a shaft of a guidewheel insertable into a recess extending into said base of said pivoting bracket and generally coaxial therewith to further link adjacent of said leading and said trailing edges.

10. An articulated door as claimed in claim 6 wherein:

said pivoting brackets extend substantially continually along said breadth of said panels.

11. An articulated door as claimed in claim 3 wherein:

said pivoting bracket has at least two of said at least one ridge.

12. An articulated door as claimed in claim 3 wherein:

said channel has a generally rectangular cross-section;

said base has a recess extending into opposite ends thereof and generally coaxial therewith; and, said retainer includes a pair of end members entirely disposed in and generally perpendicular to a bottom of said channel for receiving one of said pivoting brackets therebetween and a pin insertable through said end members and into said recess to support said pivoting bracket for pivotal rotation about said axis of said channel.

13. An articulated door as claimed in claim 1 wherein:

said channel has a rectangular cross-section and houses an insert with a circular groove of generally C shaped cross-section for receiving said base of said pivoting bracket;

an outer face of said base engages an inner face of said C shaped channel for relative pivotal movement therebetween; and, said connecting means further includes a relieved portion on said base generally perpendicular to said mounting face for facilitating passage of said base into and out of said channel; and, inwardly extending opposite edges of said channel act as said retainer by engaging said outer face of said base as said pivoting bracket is pivoted to move said relieved portion away from one of said opposite edges.

14. An articulated door as claimed in claim 2 wherein:

said base of said connector is tubular; and, said connector is of extruded construction.

15. An articulated door as claimed in claim 14 wherein:

said connector is of a plastics material.

16. An articulated door comprising:

a plurality of adjacent panels including a first, a last and at least one intermediate panel;

each said last and intermediate panel having a leading edge;

each said first and intermediate panel having a trailing edge;

each said leading edge registers with an adjacent of said trailing edges;

each said last and intermediate panel having a continuous channel extending into and running along the entire breadth of a rearward face thereof, said channel having an axis;

at least one pivoting bracket, for linking each adjacent pair of said panels, each of said pivoting brackets consisting of, a generally cylindrical base received in said channel and generally coaxial with said axis of said channel and an arm rigidly connected to and extending from said base, said arm having a mounting face on a base side thereof registering with and secured to a rearward face of one of said intermediate or first panels adjacent said trailing edge, said mounting face being generally tangential to said base;

connecting means for releasably connecting each said pivoting bracket to said adjacent panels when said adjacent panels are positioned with said rearward faces generally coplanar, said connecting means including at least one fastener for securing said arm to said rearward face of said intermediate or first panel and a relieved portion on said base generally perpendicular to said mounting face for facilitating passage of said base into and out of said channel, a recess extending into at least on end of said base for receiving a guidewheel shaft; and, a retainer acting between said channel and said base for retaining said base in said channel at least during relative pivoting of adjacent of said panels away from a closed configuration, said retainer being entirely disposed within said channel.

17. An articulated door as claimed in claim 16 wherein said arm of said connector further comprises:

a first part proximal said base and adjacent said rearward face of respective of said bottom and intermediate panels;

a second part distal said base, said mounting face being on said second part; and, a rib extending along said base of said arm generally parallel to the axis of said generally cylindrical base, between said first and second parts, said rib acting as an alignment indicator for mounting said connector to said panels.

18. An articulated door as claimed in claim 17 wherein:

at least one ridge extends along the said first part of said connector on said base side thereof and abuts against said rearward face of respective of said last and intermediate panels when said articulated door is in a closed arrangement to maintain a portion of said base side of said first part and said rearward face in a spaced apart relationship.

19. An articulated door as claimed in claim 18 wherein:

said base of said connector is tubular; and, said connector is of extruded construction.

20. An articulated door as claimed in claim 19 wherein:

said connector is of plastics material.

21. An articulated door as claimed in claim 18 wherein:

said channel has a generally C shaped cross-section;

an outer face of said base engages an inner face of said C shaped channel for relative pivotal movement therebetween; and inwardly extending opposite edges of said channel defined by said insert act as said retainer by engaging said outer face of said base as said pivoting bracket is pivoted to move said relieved portion away from one of said opposite edges.

22. An articulated door as claimed in claim 21 wherein:

said connector has at least two of said at least one ridge.

23. An articulated door as claimed in claim 18 wherein:

said channel has a generally rectangular cross-section;

said base has a recess extending into opposite ends thereof and generally coaxial therewith;

said retainer includes a pair of end members entirely disposed in and generally perpendicular to a bottom of said channel for receiving one of said pivoting brackets therebetween, and a pin insertable through said end members into said recess to support said pivoting bracket for pivotal rotation about said axis of said channel.

24. An articulated door as claimed in claim 18 wherein said channel has a rectangular cross-section and houses an insert with a circular groove of generally C-shaped cross-section for receiving said base of said pivoting bracket;

an outer face of said base engages an inner face of said C shaped channel for relative pivotal movement therebetween; and, inwardly extending opposite edges of said channel defined by said insert act as said retainer by engaging said outer face of said base as said pivoting bracket is pivoted to move said relieved portion away from one of said opposite edges.

25. An articulated door as claimed in claim 16 wherein:

said pivoting brackets extent substantially continually along said breadth of said panels.

26. An articulated door as claimed in claim 17 wherein:

said base of said connector is tubular; and, said connector is of extruded construction.

27. An articulated door as claimed in claim 26 wherein:

said connector is of a plastics material.

28. An articulated door as claimed in claim 26 wherein:

said connector has at least two of said at least one ridge.

* * * * *